US006817479B1

(12) United States Patent
Ferry et al.

(10) Patent No.: US 6,817,479 B1
(45) Date of Patent: Nov. 16, 2004

(54) CLOSURE AND A LINER HAVING A SEALING FLANGE WITH AN INWARDLY DIRECTED UNFLATTENED FOLD

(75) Inventors: Andrew Ferry, Stirlingshire (GB); Peter Douglas Kerr, Alloa (GB); David Senior, Perthshire (GB)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/914,473

(22) PCT Filed: Feb. 22, 2000

(86) PCT No.: PCT/GB00/00621

§ 371 (c)(1),
(2), (4) Date: Aug. 29, 2001

(87) PCT Pub. No.: WO00/51904

PCT Pub. Date: Sep. 8, 2000

(30) Foreign Application Priority Data

Mar. 3, 1999 (GB) ..... 9904760

(51) Int. Cl.[7] ..... B65D 53/00

(52) U.S. Cl. ..... 215/341; 215/18; 215/252; 215/320; 215/342; 215/343; 215/350; 215/354

(58) Field of Search ..... 215/342, 341, 215/343, 349, 354, 329, 252, 320, 45, 18, 350, 351; 220/304

(56) References Cited

U.S. PATENT DOCUMENTS

| | | | | | |
|---|---|---|---|---|---|
| 2,443,086 | A | * | 6/1948 | Turenne | 215/343 |
| 2,989,204 | A | * | 6/1961 | Marx et al. | 215/350 |
| 3,235,114 | A | * | 2/1966 | Blackwood et al. | 215/350 |
| 3,771,683 | A | * | 11/1973 | Dickey | 215/252 |
| 4,176,757 | A | | 12/1979 | Podesta | |
| 4,238,042 | A | * | 12/1980 | Hatakeyama et al. | 215/341 |
| 4,258,854 | A | | 3/1981 | Wright | |
| 4,823,967 | A | * | 4/1989 | Thompson | 215/344 |
| 5,188,249 | A | * | 2/1993 | Cargile | 215/341 |
| 5,533,823 | A | * | 7/1996 | Pierpont et al. | 215/342 |
| 5,971,179 | A | * | 10/1999 | Christmas et al. | 215/18 |
| 6,357,614 | B1 | * | 3/2002 | Kerr | 215/21 |

FOREIGN PATENT DOCUMENTS

| | | | | |
|---|---|---|---|---|
| EP | 0 051 568 | A1 | 10/1981 | |
| EP | 552086 | A1 * | 7/1993 | |
| EP | 0 847 930 | A1 | 9/1997 | |
| FR | 1197452 | * | 12/1959 | |
| FR | 1357217 | * | 2/1964 | |
| FR | 1378262 | * | 10/1964 | |
| GB | 710470 | * | 6/1954 | |
| GB | 769 259 | | 4/1955 | |
| GB | 1019316 | * | 2/1966 | 215/349 |
| GB | 1 590 206 | | 5/1978 | |
| GB | 2 026 428 | A | 7/1979 | |
| WO | WO 96/04179 | | 7/1995 | |

* cited by examiner

*Primary Examiner*—Robin A. Hylton
(74) *Attorney, Agent, or Firm*—Diller, Ramik & Wight

(57) ABSTRACT

A closure (2A) overlies a liner (6) which seals a container mount defined by a peripheral edge (12) of the container. The liner (6) includes a sealing flange (31) having an upstanding outermost terminal rim (40) of resilient material which is folded inwardly during closing movement of the closure shell (2A) toward the sealing flange (31) to form an unflattened fold constituting a biasing means for biasing the periphery of the sealing flange (31) against the peripheral edge (12) of the container mouth.

17 Claims, 4 Drawing Sheets

CLOSURE AND A LINER HAVING A SEALING FLANGE WITH AN INWARDLY DIRECTED UNFLATTENED FOLD

BACKGROUND OF THE INVENTION

This invention relates to an improved sealing wad or liner for use in closure caps. The invention is particularly suitable for use with ROPP (Roll-On Pilfer Proof) closures and in conjunction with pourers or non-refilling devices fitted inside the bore of a container neck.

A sealing wad or liner is often used in association with known closures. Generally, such closures have a planar crown, to cover the container mouth, and a tubular skirt which depends from the periphery of the crown and is adapted to locate on the outside of the container by, for example, threaded engagement. A sealing wad or liner is received adjacent to the closure crown to provide a seal around the mouth of the container.

For example, FR1378262 describes a plastic disc for use in conjunction with a metal crown. The plastic disc has a projecting annular wall of approximately the same diameter as the internal diameter of a bottle neck and a peripheral lip perpendicular to the disc. As the metal crown is applied to the bottle the lip deforms and seals around the outside of the bottle neck and the annular wall seals against the inside.

In an ROPP closure, a capsule made of thin metal is removably attached to the container. The capsule is fitted in position on the container neck and thread formations are rolled into the capsule skirt, conforming automatically to the underlying threads on the container neck to provided the necessary threaded engagement between the two. At the same time as the thread is formed, the free edge of the skirt is usually rolled inwardly under an annular shoulder on the container. This, in combination with a line of weakening provided around the periphery of the skirt, forms a tamper evident or security band. When the closure is unscrewed for the first time, this band separates from the remainder of the closure along the line of weakening, thereby providing visual evidence that an attempt has been made to open the container.

A waxed, cardboard sealing wad is usually provided in conventional ROPP closures. The sealing wad is retained in the capsule by means of an annular retaining bead formed around the periphery of the closure skirt, adjacent to the crown. When the container is capped, the mouth of the container locally deforms the cardboard sealing wad, to provide a seal. However, cardboard sealing wads are not always suitable, particularly when the container is provided with a device that is designed to be substantially or wholly received in the neck of the container; hereinafter referred to as "in-bore", devices. Such devices include, for example, pourers and non-refilling devices for insertion in containers of fine spirits.

SUMMARY OF THE INVENTION

Accordingly the present invention provides a closure comprising a closure shell and a liner adapted to seal the mouth of a container, the liner having a sealing flange, arranged to overlie the container mouth, the sealing flange having an upstanding rim around its periphery, characterised in that on application of the closure on the container the upstanding rim folds towards the sealing flange, without folding completely flat, thereby constituting a biasing means for biasing the periphery of the sealing flange against the outside edge of the container mouth.

In particular, the invention provides a means of improving the seal between a closure and a container fitted with an in-bore device, such as a non-refilling device.

Various proposals for in-bore, non-refilling devices are described in Patent Publications U.S. Pat. No. 4,258,854, GB 2026428, WO 96/04179 and WO 98/42587. In U.S. Pat. No. 4,258,854, WO 96/04179 and WO 98/42587, the housing of the non-refilling device is provided with an annular flange which is arranged to overlie the rim of the container. The annular flange acts as a closure liner and provides a seal when the closure is fully tightened onto the container. The annular flange is adapted to releasably engage with the main body of the non-refilling device. Thus, the in-bore device can be assembled inside the closure cap prior to delivery to the bottling line. The combined closure and in-bore device can then be applied to the container neck as a single unit, reducing the time required to cap the bottles.

A disadvantage of this arrangement is that it is difficult to obtain as good a seal as can be achieved using the conventional cardboard wad. This causes particular problems when the filled bottles are being transported or stored in adverse conditions, such as hot and humid conditions. However, use of a conventional cardboard wad in conjunction with a non-refilling device is considered unacceptable as the closure has to be applied to the bottle independently of the in-bore device which increases process times and costs.

Therefore, the present invention also aims to provide an in-bore device, such as a non-refilling device, having the advantages of the existing in-bore devices but with improved sealing performance. The device must be capable integration with the closure or capsule for delivery to the filling line, relatively cheap and easy to mould and easy to assemble, but should seal the container opening as well as a closure containing a conventional cardboard wad.

Accordingly, the present invention also provides an in-bore device for a container having a body portion, at least part of which is adapted to be held firmly in the neck of a container, and a liner portion, arranged to be held captive in a closure and to co-operate releasably with the body portion, the liner portion having a sealing flange, arranged to overlie the container mouth, the sealing flange having an upstanding rim around its periphery, characterised in that on application of the closure and in-bore device to the container the upstanding rim folds towards the sealing flange, without folding completely flat, thereby constituting a biasing means for biasing the periphery of the sealing flange against the outside edge of the container mouth.

The liner according to the invention is preferably made of a plastics material. When used in conjunction with an in-bore device, the liner is provided with means for releasable engagement with the body portion of the in-bore device. This releasable connection may be provided, for example, by a snap fit arrangement or by frangible bridges, which break on first opening of the container. The in-bore device and liner may be inserted into the closure cap and the resultant integrated unit provided to the bottling line for insertion into the neck of a container.

The upstanding rim is located around the periphery of the liner, between the opposed surfaces of the liner and the crown of the closure. As the closure is applied to the container, the force applied to the closure crown by the capping head folds the upstanding rim towards the sealing flange, which in turn forces the periphery of the liner around the outside edge of the mouth of the container, thereby providing a seal. The upstanding rim may be segmented or shaped to provide the required sealing force. Where the closure crown is made from a thin, deformable material, such as in an ROPP closure, the upstanding rim is preferably continuous, to reduce the risk of producing a witness mark on the crown of the closure during the capping process.

The upstanding rim around the periphery of the liner is configured to have a spring characteristic when it is folded. As the closure is applied to the container, the spring bias in the folded structure provides the biasing force required to force the periphery of the liner around the outside edge of the rim of the container. The biasing effect of the liner is not reliant on the inherent resilience of the liner material. Thus, the invention is particularly advantageous where the liner is made from a relatively rigid material due to the need to provide engagement means, so that the liner can be releasably connected to an in-bore device, for example.

On application of the closure to the container, the upstanding rim is folded towards the sealing flange by the force exerted on the crown of the closure by the capping head. In its folded configuration, the rim acts like a folded spring and biases the periphery of the liner around the outside edge of the container mouth. In order to ensure that the folded rim acts like a folded spring rather than a local material thickening, it is important that the rim is not folded completely flat against the sealing flange.

Preferably, a spacer is provided between the opposed surfaces of the crown of the closure and the liner. The spacer may take the form of an upstanding boss, a number of discrete upstanding bosses or an annular ridge. Where the closure crown is made from a thin, deformable material, such as in an ROPP closure, the spacer is preferably a solid boss which extends over substantially the whole surface of the closure crown, in order to reduce the risk of witness marks appearing on the crown.

The spacer preferably defines a cavity into which the upstanding rim can fold. Again this ensures that the liner presents a smooth surface to the closure crown and does not give rise to witness marks on the crown during capping. The spacer may be adapted to prevent the fold, between the rim and the periphery of the sealing flange, from buckling and folding completely flat. If the fold is completely flattened the additional spring bias effect will not be achieved.

The closure liner according to the invention provides an effective seal by wrapping the periphery of the liner around the outside edge of the container mouth. The liner is simple to mould and may be provided with other features, such as engagement tabs for connection of the liner to an in-bore device for example.

The invention will now be described, by way of example only, with reference to the accompanying drawings, in which:

DESCRIPTION OF THE PREFERRED EMBODIMENTS

Figure 1:
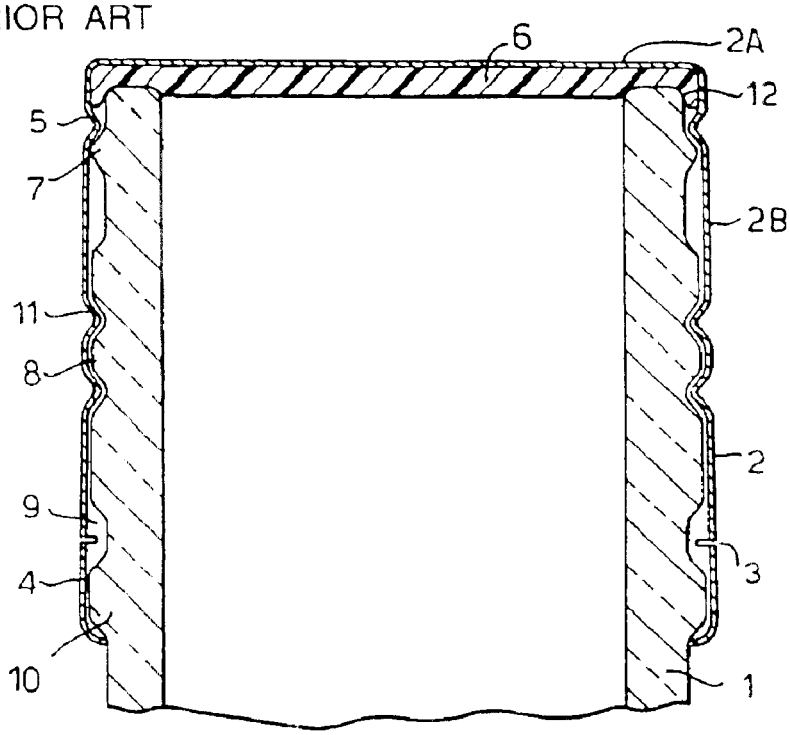
Fig.1. PRIOR ART
FIG. 1 shows a side section view of a conventional ROPP closure fitted to a bottle.

Where possible in the drawings, like components have been given the same reference numerals.

Referring to the prior art shown FIG. 1, a bottle 1 is fitted with a capsule or shell 2 of the well-known ROPP variety. The capsule is stamped from aluminium and has a generally planar crown 2A and a tubular skirt 2B. Near its free end, the skirt 2B has a circumferential line of weakening 3 comprising a number of slits. This line of weakening defines a tamper evident band 4, which is retained on the bottle when the remainder of the capsule is removed. A small annular retaining bead 5 is formed around the skirt 2B at a small distance from the crown 2A. In conventional ROPP closures of this type, a cardboard wad 6 is provided to seal the neck of the bottle 1. The wad 6 is retained adjacent to the crown 2A by the retaining bead 5.

The neck of the bottle 1 has a generally cylindrical exterior surface with a stop bead 7 defined thereon. The stop bead 7 engages with the retaining bead 5, to define the axial position of the capsule on the bottle. The finish portion of the bottle 1 also has screw threads 8, a recess 9 arranged to align with the line of weakening 3 on the capsule, and a shoulder 10.

The capsule 2, with the retaining bead 5 already formed and the wad 6 inserted, is placed over the neck of the bottle 1. A tool is then rolled around the tubular skirt 2B of the capsule in the region of the screw threads 8 on the bottle, to form complimentary screw threads 11 in the capsule 2. The free end of the tubular skirt 2B is curled inwardly below the shoulder 10, to retain the tamper evident band 4 on the bottle 1 and to remove the sharp edge. When the capsule is opened, the unscrewing action fractures the line of weakening 3, severing the tamper evident band 4 from the rest of the capsule. The tamper evident band 4 is retained on the neck of the bottle by the shoulder 10, when the rest of the capsule 2 is removed.

Figure 2:
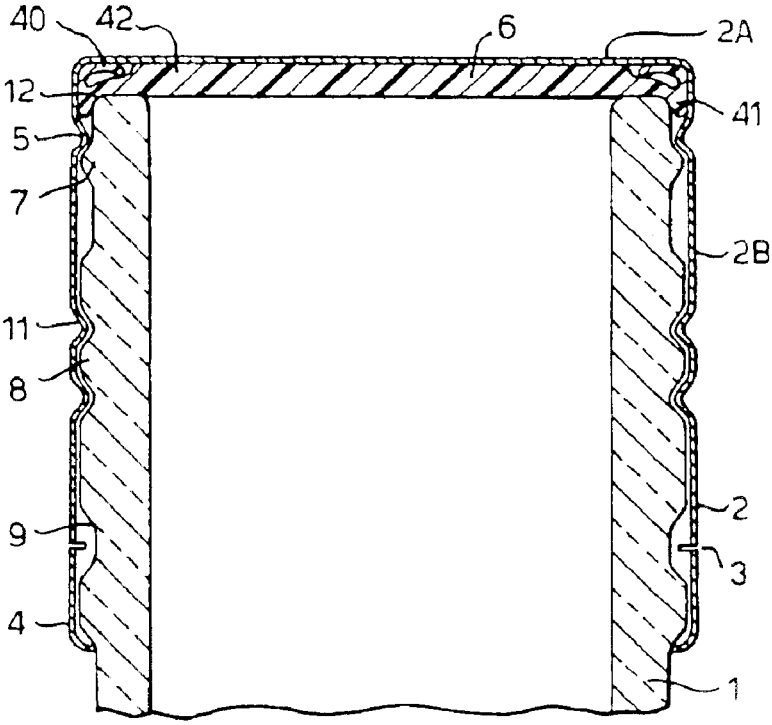
FIG. 2 shows a side section view of an ROPP closure having a liner according to the invention, fitted to a bottle.

FIG. 2 shows the same ROPP closure as FIG. 1 with a liner 6 modified according to the invention. The liner 6 comprises a flange portion (not labelled) which extends over the rim of the opening in the bottle 1. The flange portion has an upstanding rim 40 around its periphery, which is folded as the ROPP closure is applied to the container. A raised central boss or annular rim 42 acts as a spacer to ensure that the fold between the rim 40 and the flange portion of the liner 6 does not collapse completely flat. The central boss 42 also defines an annular recess into which the rim 41 can fold. This presents a substantially smooth surface to the underside of the capsule crown 2A, ensuring that witness marks do not appear on the surface of the crown 2A during capping.

The folded rim 40 applies a biasing force to the periphery 41 of the liner 6, pushing the periphery 41 around the outside edge of the rim 12 of the container opening. By curling the periphery 41 of the liner around the outside edge of the rim 12, the sealing performance of the liner is improved. The spring bias of the fold increases the biasing force on the periphery 42 of the sealing flange, compared to a liner which relies purely on compression of the liner material to provide the necessary sealing force. This is particularly important where the liner material has to be relatively hard, due to other design considerations such as the requirement to provide snap beads to allow the liner to be releasably connected to an in-bore device.

Figure 3:
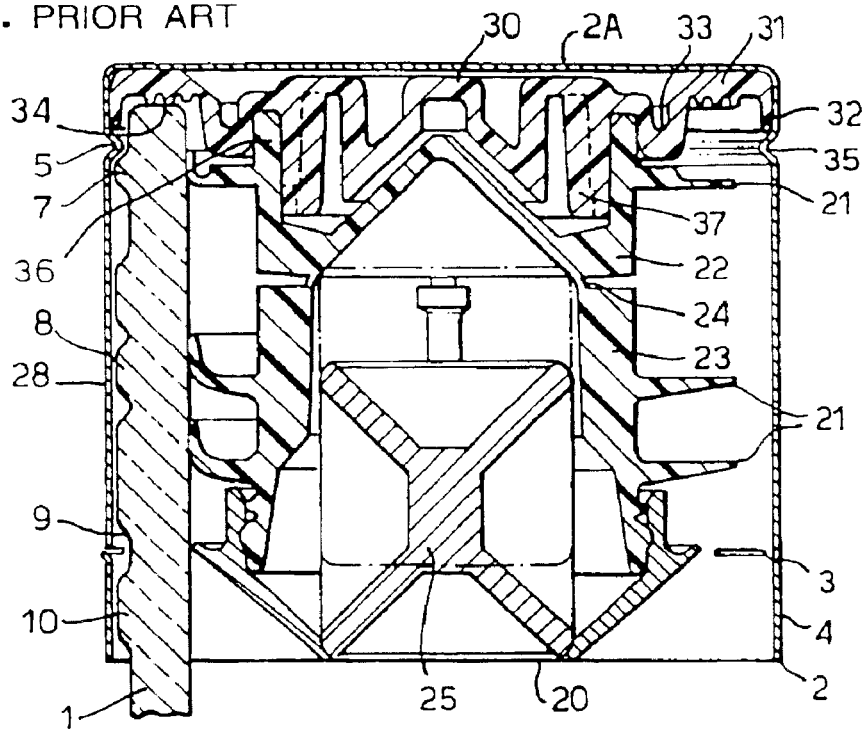
Fig.3. PRIOR ART
FIG. 3 shows a side section view of a known in-bore, non-refilling device inserted in the neck of a bottle and surrounded by a ROPP closure.

Referring to the prior art shown in FIG. 3, a glass bottle 1 is fitted with a known in-bore, non-refilling device 20. These devices are often used in bottles of fine spirits, such as Scotch Whisky. The non-refilling device 20 is held captive inside the neck of the bottle by a number of flexible outwardly projecting fins 21. The device 20 generally comprises a housing which has upper and lower parts 22, 23 respectively, joined together by frangible bridges 24 of smaller cross sectional dimension than the remainder of the housing. A valve member 25 is held captive within the housing 22,23 and is adapted to engage with a valve seat in the housing, to prevent refilling of the bottle. The frangible bridges 24 are designed to rupture, should someone try to tamper with the action of the valve member 25 and thereby refill the bottle.

The non-refilling device 20 also comprises a liner 30. The liner 30 is generally in the shape of a corrugated disc, having an elevated outer flange 31 with a downturned free edge 32. Adjacent to and inside the outer flange 31, the liner has an upwardly open peripheral groove 33. The groove 33 and flange 31 define a recess 34 in which the rim of the bottle 1 may be received and sealed. In order to enhance the seal between the liner and the rim of the bottle, the underside of the flange 31 may be formed with a number of concentric, compliant and downwardly projecting sealing beads 35. Thus, the seal is formed on the top surface of the rim of the bottle opeining.

The liner 30 also comprises a number of depending catch members 37, which are arranged to co-operate with a complimentary portion 36 on the upper part of housing 22. The catch members 37 and upper part of the housing 22 allow the liner 30 and the main body 22, 23 of the non-refilling device 20 to be releasably connected together.

The, non-refilling device 20 is assembled by connecting the liner 30 to the main body 22, 23. The assembled non-refilling device 20 is then pushed into the ROPP capsule 2 with the liner 30 leading. The downturned edge 32 of the liner 30 snap engages behind the retaining bead 5, which has been pre-formed in the capsule. The assembly of the device 20 and capsule 2 as it appears at this stage, is shown on the right hand side of FIG. 2. The closure is now ready for use in a bottling plant.

In the bottling plant, the capsule 2 is pushed over the neck of a product filled bottle 1 and the non-refilling device 20 becomes lodged in the neck of the bottle 1 by means of the fins 21 (as shown on the left hand side of FIG. 2). As previously described, screw threads (not shown) are then rolled into the capsule in conformity with the screw threads 8 provided on the bottle finish portion and the free edge of the capsule 2 is rolled under the shoulder 10 to secure the tamper evident band 4 to the bottle.

To open the bottle, the user unscrews the capsule 2, leaving the tamper evident band 4 on the bottle. The liner 30 is held captive in the capsule 2 by the retaining bead 5 and is therefore separated from the body 22, 23 of the non-refilling device. When the capsule 2 is screwed back onto the bottle, the liner 30 re-engages with the upper part of the body 22 via the catch members 37.

Figure 4:
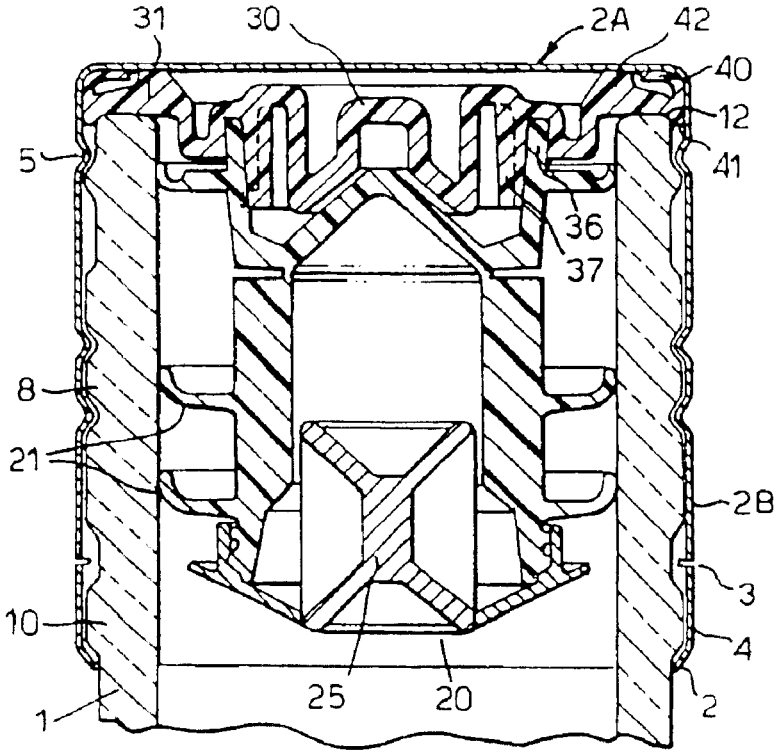
FIG. 4 shows a side section view of the same in-bore, non-refilling device shown in FIG. 3, with a modified liner according to the invention.

FIG. 4 shows generally the same in-bore, non-refilling device 20 as shown in FIG. 3 but with a modified liner 30 according to the invention. The liner 30 has a number of depending catch members 37, arranged to co-operate with a complimentary portion 36 on the upper part of the non-refilling device housing 22.

The liner 30 is generally in the shape of a corrugated disc and comprises a flange portion 31 which extends over the rim of the bottle opening. The flange portion 31 has an upstanding rim 40 around its periphery, which is folded when the ROPP closure is applied to the container. A raised central boss or annular rim acts as a spacer 42 between the crown 2A of the capsule and the sealing flange 31. Spacer 42 is sized to ensure that the fold between the rim 40 and the flange portion 31 does not collapse completely flat. The central bass 42 defines an annular recess into which the rim 41 can fold. This presents a substantially smooth surface to the underside of the capsule crown 2A, ensuring that witness marks do not appear on the surface of the crown 2A during capping.

During capping, the rim 40 is folded towards the sealing flange 31 by the force applied to the crown 2A of the capsule. The folded rim 40 applies a biasing force to the periphery 41 of the liner, pushing it around the outside edge 12 of the rim of the container opening, to provide an improved seal.

The remaining features of the non-refilling device are the same as those shown in FIG. 3. The capping procedure is also as generally described in relation to FIG. 3.

Figure 5:
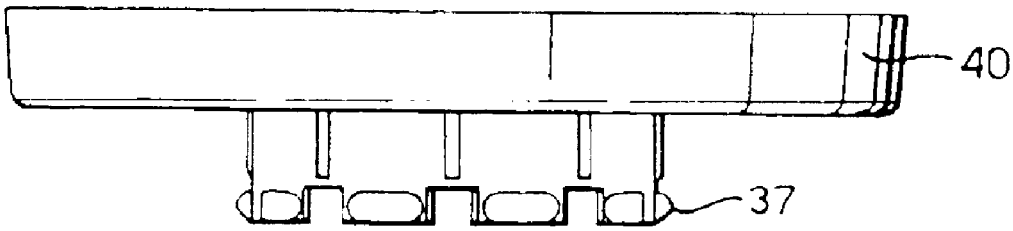
FIG. 5 shows an isometric view of the modified liner shown in FIG. 4, in its as-moulded configuration.
Figure 6:
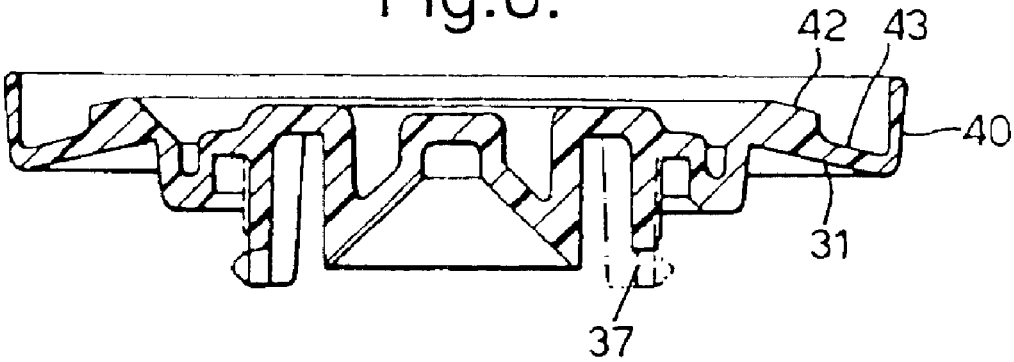
FIG. 6 shows a side section view of the modified liner shown in FIG. 5.

Referring to FIGS. 5 and 6, a liner according to one embodiment of the invention, which is suitable for use in conjunction with an in-bore device, comprises a sealing flange 31 which is sized so that it extends over the rim of a container opening. An upstanding rim 40 extends around the periphery of the sealing flange 31. When a closure containing the liner is applied to a container, the force applied to the crown of the closure causes the upstanding rim 40 to fold towards the sealing flange 31 as previously described in relation to FIGS. 2 and 4.

In its as-moulded configuration (shown in FIGS. 5 and 6), the sealing flange 31 slopes downwardly towards the periphery of the liner, whilst the upstanding rim 40 is substantially vertical. This configuration ensures that the rim 40 folds during capping and that the periphery of the liner seals around the outside edge of the rim of the container opening (as discussed in relation to FIGS. 7A to 7D below). This arrangement also allows the liner to be retained in a closure by a conventional wad bead.

The liner may also comprise a number of depending catch members 37, arranged to co-operate with complimentary portions on the upper part of an in-bore device. A spacer 42 is provided inside the rim 40, suitably spaced to provide a recess 43 into which the rim 40 can fold. The spacer 42 is also arranged to provide the liner with a substantially flat upper surface to prevent witness marks appearing on the visible surface of the closure crown.

Figure 7A:
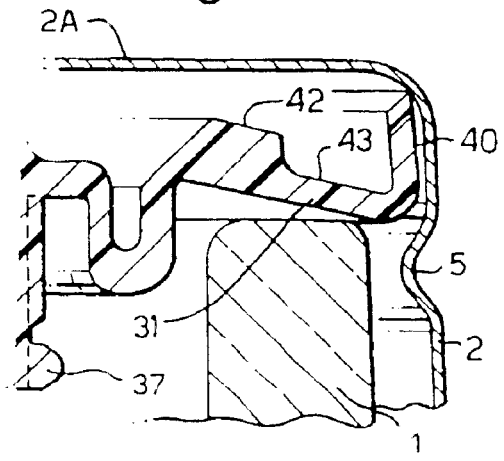
FIGS. 7A to 7D show the liner of FIGS. 4 to 6 in its as-moulded configuration, first and second partially compressed configurations and with the closure fitted to the container respectively.
Figure 7B:
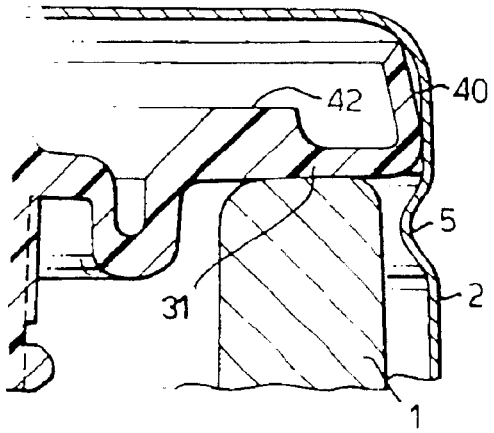
Figure 7C:
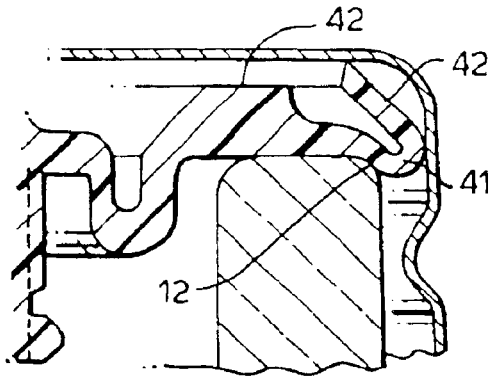
Figure 7D:
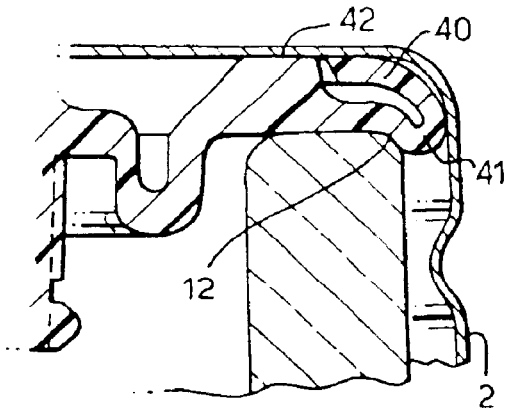

FIGS. 7A to 7D show the configuration of the liner in an ROPP capsule at four stages during the capping process. FIG. 7A shows the liner in its as-moulded configuration, FIGS. 7B and 7C show the liner at two intermediate stages and FIG. 7D shows the liner configuration when the ROPP capsule is fully fitted on the container.

Referring to FIG. 7A, the liner comprises a sealing flange 31, which extends over the rim of a container opening. An upstanding rim 40 extends around the periphery of the sealing flange 31. In the liner's as-moulded configuration, the sealing flange 31 slopes downwardly towards the periphery of the liner and the upstanding rim 40 extends substantially vertical to the main plane of the liner. The liner is connected to the remainder of an in-bore device by catch members 37. The assembled in-bore device (only liner shown) is then inserted into an ROPP capsule 2 and the liner snaps behind the annular retaining bead 5, thereby retaining the device within the capsule. The in-bore device is then placed into the neck of a container 1 and the capsule fits around the outside of the container neck. Force is applied to the closure crown 2A to force the in-bore device into the bore of the container opening.

As shown in FIG. 7B, the force applied to the closure crown 2A forces the lower surface of the sealing flange 31 into contact with the rim of the container opening. This forces the sealing flange 31 into a substantially horizontal configuration and thereby cams the upstanding rim 40 slightly inward from its initial vertical position.

Referring to FIG. 7C, further force on the closure crown 2A acts on the upstanding rim 40 to push the periphery of the sealing flange 41 around the outside edge 12 of the rim of the container opening and also forces the upstanding rim 40 to fold towards the upper surface of the liner, into the recess left by the spacer 42.

Finally, as shown in FIG. 7D, the force on the closure crown 2A pushes the crown 2A into contact with the spacer 42. Screw threads conforming to the threads on the container 1 are then rolled into the capsule 2 as previously described. In this fully capped configuration, the closure crown 2A is in contact with the Spacer 42 and the rim 40 is folded towards the upper surface of the liner. The fold between the sealing flange 31 and rim 40 acts in the same way as a folded spring and maintains a sealing force on the periphery of the liner 41. The free end of the rim 40 may be forced into contact with the upper surface of the liner but complete collapse of the fold is avoided. The spacer 42 may be sized and arranged to ensure that complete collapse of the fold does not occur. This ensures that the folded rim 40 acts as a spring, biasing the periphery 41 of the liner around the outer rim of the container opening 12 even when the liner material is relatively rigid.

Although a preferred embodiment of the invention has been specifically illustrated and described herein, it is to be understood that minor variations may be made in the apparatus without departing from the spirit and scope of the invention, as defined the appended claims.

What is claimed is:

1. A closure comprising a closure shell (2A) and a liner (6) adapted to seal the mouth of a container, means (5) for retaining the liner (6) in the closure shell (2A), the liner (6) having a sealing flange (31) adapted to overlie the container mouth, the sealing flange (31) having an upstanding outermost terminal rim (40) of resilient material around a periphery of the sealing flange (31), characterized in that on application of the closure shell (2A) on the container, the upstanding rim (40) is folded inward by the closure shell (2A) towards the sealing flange (31) to form an unflattened fold constituting a biasing means for biasing the periphery of the sealing flange (31) against the outside edge (12) of the container mouth, and means (42) radially inboard of said upstanding rim (40) for preventing said upstanding rim (40) from folding flat.

2. A closure according to claim 1, wherein the unflattened fold of the upstanding rim (40) is adapted to bias a periphery (41) of the liner (6) around the outside edge of the rim of the container.

3. A closure according to claim 1, wherein said preventing means (42) comprises a spacer (42) between opposed surfaces of the sealing flange (31) and the closure shell (2A); and the spacer (42) is arranged to prevent the upstanding rim (40) from folding completely flat.

4. A closure according to claim 3, wherein the spacer (42) provides a recess into which the upstanding rim (40) can fold.

5. A closure according to claim 1, wherein the upstanding rim (40) is arranged substantially parallel to a central axis of the closure, and the sealing flange (31) is arranged at an acute angle to the upstanding rim (40) whereby the sealing flange (31) cams the upstanding rim (40) inwardly as the sealing flange (31) contacts the neck (1) of the container.

6. An in-bore device for a container having a body portion (20) at least part of which is adapted to be held firmly in the neck (1) of a container and a liner portion (30), means (5) for retaining the liner portion (30) in a closure (2A), the liner portion (30) having a sealing flange (31) arranged to overlie a mouth of the container, the sealing flange (31) having an upstanding outermost terminal rim (40) of resilient material around a periphery of the sealing flange (31), characterized in that on application of the closure (2A) and in-bore device (20) to the container, the upstanding rim (40) is folded inwardly by the closure (2A) towards the sealing flange (31) to form an unflattened fold constituting a biasing means for biasing the periphery of the sealing flange (31) against the outside edge (12) of the container mouth, and means (42) radially inboard of said upstanding rim (40) for preventing said upstanding rim (40) from folding flat.

7. A closure according to claim 2, wherein said preventing means (42) comprises a spacer (42) between opposed surfaces of the sealing flange (31) and the closure; and the spacer (42) is arranged to prevent the upstanding rim (40) from folding completely flat.

8. A closure according to claim 2, wherein the upstanding rim (40) is arranged substantially parallel to a central axis of the closure and the sealing flange (31) is arranged at an acute angle to the upstanding rim (40) whereby the sealing flange (31) cams the upstanding rim (40) inwardly as the sealing flange (31) contacts the neck (1) of the container.

9. A closure according to claim 3, wherein the upstanding rim (40) is arranged substantially parallel to a central axis of the closure and the sealing flange (31) is arranged at an acute angle to the upstanding rim (40) whereby the sealing flange (31) cams the upstanding rim (40) inwardly as the sealing flange (31) contacts the neck (1) of the container.

10. The combination of a container, a liner and a closure, the container including a neck and a mouth defining a pour opening, the liner having a sealing flange (31) overlyingly seated upon the container mouth, the sealing flange (31) having an upstanding outermost terminal rim (40) of resilient material around an outermost periphery of the sealing flange (31), the upstanding rim (40) being folded inwardly by direct contact of the closure toward the sealing flange (31) to form an unflattened fold constituting a biasing means for biasing the periphery of the sealing flange (31) against an outside edge (12) of the container mouth, and means (42) radially inboard of said upstanding rim (40) for preventing said upstanding rim (40) from folding flat.

11. The combination as defined in claim 10 wherein the unflattened fold of the upstanding rim (40) is adapted to bias a periphery (41) of the liner (6) around the outside edge of the rim of the container.

12. The combination as defined in claim 10 wherein said preventing means (42) comprises a spacer (42) between opposed surfaces of the sealing flange (31) and the closure; and the spacer (42) is arranged to prevent the upstanding rim (40) from folding completely flat.

13. The combination as defined in claim 12 wherein the spacer (42) provides a recess into which the upstanding rim (40) can fold.

14. The combination as defined in claim 10 wherein the upstanding rim (40) is arranged substantially parallel to a central axis of the closure and the sealing flange (31) is arranged at an acute angle to the upstanding rim (40) whereby the sealing flange (31) cams the upstanding rim (40) inwardly as the sealing flange (31) contacts the neck (1) of the container.

15. The combination as defined in claim 10 wherein the upstanding rim (40) is arranged substantially parallel to a central axis of the closure.

16. The combination as defined in claim 11 wherein said preventing means (42) includes a spacer (42) between opposed surfaces of the sealing flange (31) and the closure; and the spacer (42) is arranged to prevent the upstanding rim (40) from folding completely flat.

17. The combination as defined in claim 16 wherein the spacer (42) provides a recess into which the upstanding rim (40) can fold.

* * * * *